United States Patent [19]

Rittinger

[11] 4,199,893

[45] Apr. 29, 1980

[54] APPARATUS FOR BRAKING AND STARTING SPRING-DRIVEN CARS

[75] Inventor: Herbert Rittinger, Blumberg, Fed. Rep. of Germany

[73] Assignee: Helmut Darda Spielwaren und Maschinenbau GmbH Im Tal, Blumberg, Fed. Rep. of Germany

[21] Appl. No.: 950,308

[22] Filed: Oct. 10, 1978

[30] Foreign Application Priority Data

Feb. 7, 1978 [DE] Fed. Rep. of Germany ..... 7803533

[51] Int. Cl.[2] ..... A63H 17/42

[52] U.S. Cl. ..... 46/1 K; 104/253

[58] Field of Search ..... 46/1 K, 202, 206; 273/86 R, 86 B; 104/249, 252, 253

[56] References Cited

U.S. PATENT DOCUMENTS

| | | | |
|---|---|---|---|
| 1,791,071 | 2/1931 | Coggon | 273/86 R X |
| 2,416,473 | 2/1947 | Fields | 104/253 |
| 2,664,831 | 1/1954 | Fields | 104/253 |
| 3,751,847 | 8/1973 | Neuhierl | 46/1 K |
| 3,958,361 | 5/1976 | Cooper et al. | 46/1 K |

*Primary Examiner*—F. Barry Shay

*Attorney, Agent, or Firm*—Haseltine, Lake & Waters

[57] ABSTRACT

A housing having a base plate adapted to be used as part of a toy track is provided. A braking-bar is provided in one side wall, that is parallel to the base plate at the level of the upper area of the wheels of a car to be used on said track and is pivotable inwardly over the track at one part of its length against a spring tension at the level of the side wall. The braking bar will press against a drive wheel of the car and prevent it from moving. A locking member is mounted in the housing and movable between two positions, that releases the braking-bar in one position and that holds the braking-bar in place pivoting inwardly in the other position.

16 Claims, 3 Drawing Figures

APPARATUS FOR BRAKING AND STARTING SPRING-DRIVEN CARS

BACKGROUND OF THE INVENTION

The present invention relates to an apparatus for starting spring-driven toy cars with a housing, having a fitted base plate being the width of the car and vertical side walls, in which at least one of the side walls is pivotable partially inward.

Wheels in spring-driven toy cars must be blocked before starting by a wound-up spring motor. This can be accomplished in the usual way either by a mechanical braking means arranged on the car or by hand, in that the wheels are held fast. Starting the car by releasing a mechanical braking means arranged on the car is expedient, because in general the car would have to be held in place to do that and would not permit an accurate start of the car, as is important in racing, for example. Blocking the wheels by hand allows for an accurate start, but the car must be held constantly up until the starting, so that the car cannot be left in a waiting position, besides which starting the car in tracks is difficult.

An apparatus for toy cars with a housing is known from the prior art, where there is employed a base plate the width of the car and side walls vertical to it. This housing is a portion of a track for these toy cars. One of the side walls of the housing is pivotable inwardly into the track, in order to brake the car driving in the track.

This well-known apparatus is not suitable, however, for starting spring-driven cars. The pivotable part of the side wall is, hinged on one end and tilts at an acute angle into the track. A car would be held at its front end by this pivotable side wall. The wheels would not be blocked and can turn freely on a car that is held fast, whereby the drive-spring releases itself.

A further braking apparatus for toy cars driven on tracks known from the prior art, in which a movable flap is arranged above the track, and is pivotable downwardly to brake the cars and lies close to the cars driving through. This apparatus is not suitable for starting the spring-driven toy cars, as the cars cannot easily fit in between the track and the flap arranged above.

SUMMARY OF THE INVENTION

It is the main object of the present invention to overcome the defects of the prior art.

It is an object of the present invention to provide an apparatus for starting spring-driven toy cars, that is simply constructed. It is another object of the invention to provide an apparatus readily fitted in the toy car in which the cars can be kept reliably in a waiting position, and which allows for an easy and accurate start of the car.

According to the invention, a braking-bar is provided in one side wall, that is parallel to the base plate at the level of the upper area of the wheels of the car and is pivotable inwardly at one part of its length against a spring tension at the level of the side wall. A locking-means movable between two positions is provided, that releases the braking-bar in one position and that holds the braking-bar in place pivoting inwardly in the other position.

In a preferred embodiment of the invention the braking-bar, when it is pivoted inwardly to hold the car in place, lies adjacent to the upper area of the wheels of the car. The torque of the wheels grasping the braking-bar is affected in that the wheels are pressed against the base plate of the housing and are thereby held fast reliably. It is not possible to lift the wheels from the base plate permitting a free rotation of the wheels.

Since the housing is open at the top, the cars with a wound-up spring motor can be easily set into the starting apparatus. The braking-bar will then be pivoted inwardly and held securely by the locking-means in the inwardly pivoted position. The cars can then remain ready to start in the rest position.

If the locking-means is released, then the braking-bars spring outwardly in the area of the side wall and the car is set free. If the locking-means consists of a slider meshed on a sloping friction surface that is movable vertically by a control-head, then starting can be easily and accurately executed by pressing down on the control-head.

The braking-bar is advantageously connected at both ends to the side wall and divided in the middle for movability. The apparatus is built symmetrically and can be used in both directions. This is particularly advantageous, if the apparatus is used as a component part of an assembled car track course. Starting of the cars is then possible in both directions.

In a further arrangement of this invention, it is possible to start a car held ready in the starting apparatus by means of a second car, that drives up behind it on a track.

The apparatus is so fitted to this purpose, that the braking-bar lies closely on the wheels of the car with only a light downward pressure. This pressure is sufficient to reliably hold the wheels. On the other hand, the pressure is so slight, that a car driving up from behind can push the car held in the starting apparatus out of the braking-bar and start it in this manner.

The arrangement according to the invention makes it possible to let a long relay of spring driven cars drive in one track. Starting apparatus according to the present invention must be set in on the track at intervals that correspond to the drive-range of the spring motor of the car. Each car when it is at the end of the drive-range reached by its spring motor, then releases the next car that is standing ready with wound-up spring motor in the starting apparatus.

It is also possible to arrange two or more braking-bars in a housing one behind the other. In this way, it would be possible to set many cars in the starting position and start them one after another.

The starting apparatus according to the invention is easily constructed and can, therefore, be manufactured at a reasonable cost. If the braking-bars are manufactured as single parts of the side wall, that are separated by slots from this sidewall, then these braking-bars are formed as spring-tongues, and as soon as the locking-means is set free the braking-bars swing backward because of material elasticity of the area of the side wall. The entire housing in this arrangement can be manufactured in one piece as a sprayed die-cast part.

Should the locking-means be made as a slider in the housing, that is, movable by means of a control-head, then this slider as well as the control-head can also be die-cast out of plastic. An especially simple installation results if the control-head and the slider with axis sections fitting into one another can be put together by a snap connector. The entire apparatus consists then of only three plastic die-cast parts, that is, the housing, the slider, and the control-head. To assemble it, the axis of the slider must be put in the guide box provided in the housing and the control-head must be placed in the axis of the slider and snapped in.

The present invention will be better understood by way of the accompanying drawings.

IN THE DRAWINGS

DESCRIPTION OF THE INVENTION

Figures 1, 2, 3:
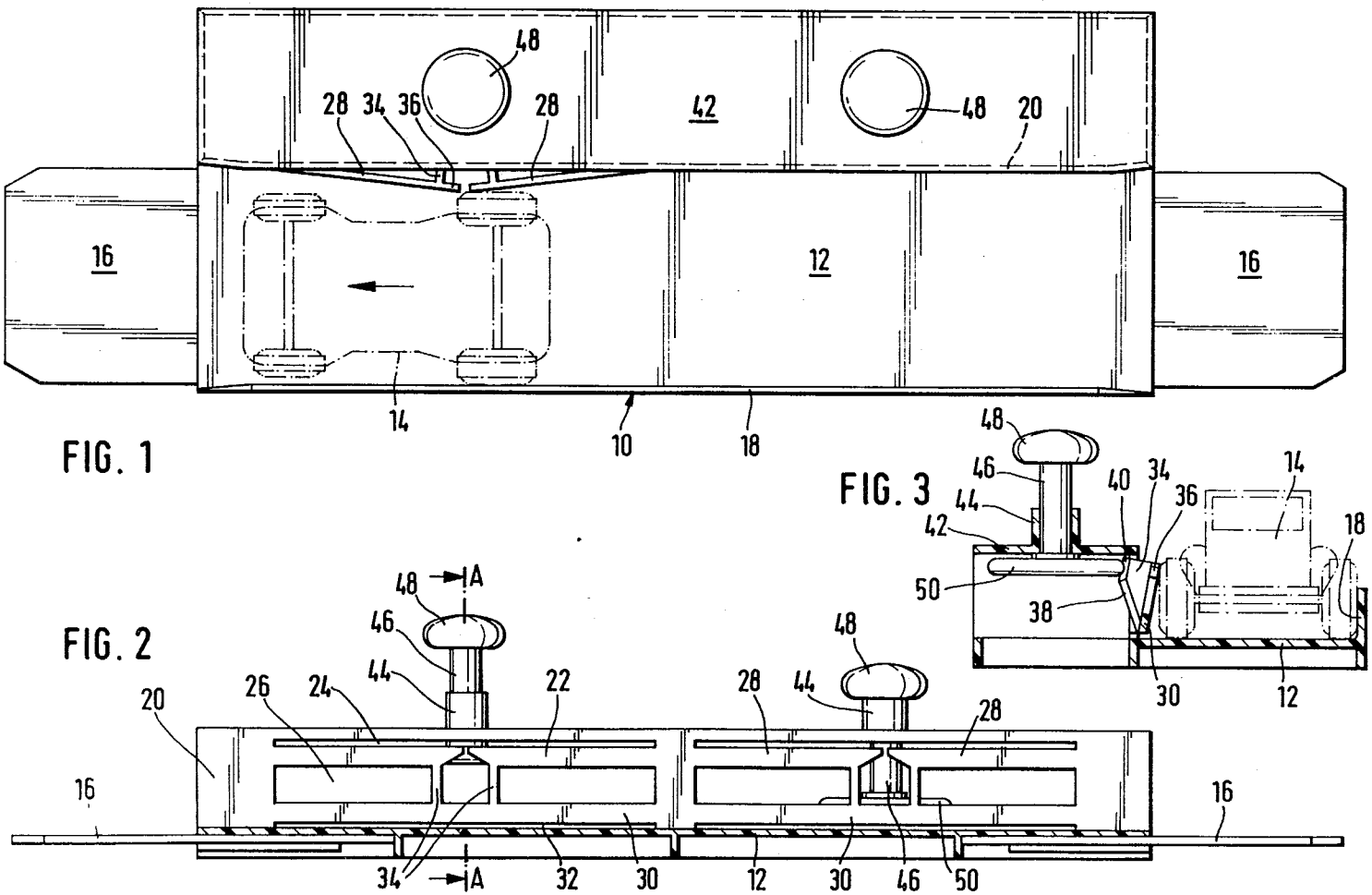
FIG. 1 is a top view of the apparatus according to the invention.
FIG. 2 is a side view of the apparatus in FIG. 1, with a cut away view of the side wall
FIG. 3 is a portion of the apparatus along the line A—A in FIG. 2.

The starting apparatus represented in the drawing is shown as a portion of a car-track which can be fitted together.

The apparatus consists of a housing 10, which shows a base plate 12, that is made as a car-track, which is fitted to the width of the toy cars 14. The housing 10 is provided with tongues 16 on both ends, that serve as connectors with the additional track portions.

Vertical side walls reach up from the base plate 12, that border the edge of the car track. The one side wall 18 is shown as a continuous wall. Side wall 18 is cut away in the illustration of FIG. 2.

Two braking-bars 22 are provided one behind the other in the other side wall 20, of which the left is shown in the blocking position and the right in the release position.

As best shown in FIG. 2, braking-bars 22 are one piece parts of the side wall 20, that are separated out of side wall 20 by length-wise slots 24 and 26. The braking-bars 22 are connected to side wall 20 at both ends. The braking-bars 22 are divided in the middle of their length so that two symmetrical sections 28 are made.

Second bars 30 are provided beneath the braking-bars 22 that are parallel to braking-bars 22 and are the same length as these bars. The bars 30 are also one piece parts of side wall 20 and are separated out of this by length-wise slots 26 and 32. The bars 30 are shown as continuous and connected at both ends with the side wall 20.

Two vertical arms 34 connect the lower bar 30 with the braking-bar 22. The vertical arms 34 are connected to both sections 28 of the braking-bars 22 close to their free end. Both sections 28 of the braking-bars 22 jut out at their free ends 36 over the vertical arms 34. The free ends 36 are tapered upwardly on their bottom edge near the end.

As shown in FIG. 3, the vertical arms 34 are like plates reaching to the outer side of the housing. The top edges 38 of these plate-like arms 34 are at an acute angle opening upwardly to the running edge in the area of the braking-bar 22 and the bar 30. The upper end of the top edge 38 forms a section 40 parallel to the running edge. The top edges 38 of both vertical arms 34 are tapered on the sides facing each other.

At the uppermost edge of the side wall 20, a flange 42 reaching out to the outer side of the housing is provided. This flange 42 has a vertical guide box 44, whose vertical axis is in the middle ground between the arms 34.

Axle 46 slides in guide box 44 having a control-head 48 arranged on the top end outside of the flange 42.

A disk 50 is added on the lower end of the axle 46 beneath flange 42. The disk 50 touches the top edge 38 of the arm 34 at is periphery.

The entire housing is made of plastic and is manufactured in one piece by a die-casting method. The axis 46 is formed of two sections, that are inserted in one another in an obvious way and are held together by a snap connector. The control-head 48, the disk 50 and the sections of axle 46 connected with these, are also plastic die-cast parts.

The inventive apparatus operates in the following manner:

A spring driven toy car 14 is put on the base plate 12 with spring works wound-up, whereby the drive wheels, for example, the rear wheels, are set by the middle of the braking-bar 22, as shown in FIG. 1.

Then the control-head 48 is pulled upwardly as shown at the left in FIGS. 1, 2 and 3. The disk 50 slides upwardly on the top edge 38 of arm 34, until it reaches the upper end section 40. The plate-like arms 34 are thereby pressed by the disk 50 inwardly to the car-track.

In the final position as shown in FIG. 3, the upper end sections 40 lean against the inner part of the housing and/or the car-track, so that the disk 50 will be held securely in the position as shown in FIG. 3 and self-acting back-sliding downward by disk 50, will be prevented.

By the upward sliding of the disk 50, the arms 34, as mentioned before, will be pivoting inward to the inner part of the housing and/or in the car-track. The lower bar 30 acts as a pivot and will be rotated elastically about its major axis. Both sections 28 of the braking-bar 22 pivot inwardly at their free ends, whereby they are also rotated slightly about their major axis. The free ends 36 with tapered under-sides come into position on the convex upper top edge of one drive-wheel, as shown in FIGS. 1 and 3. The tapering of the free ends 36 as well as the light torsion of the sections 28, have the effect that the drive-wheels are not only pressed against the opposite side walls 18 by tilting outwardly of the braking-bar 22 but in addition, a force component results that presses the drive-wheels against the base plate 12, so that optimal blocking of the drive wheels is secured.

If the control-head is pushed down by hand, then the disk 50 slides out of the rest position shown in FIG. 3 down to the positions shown at the right in FIGS. 1 and 2. The level of the disk 50 is then at the height of the lower bar 30. By the placement of the disk 50, the arms 34 pivot again toward the top edge of the housing, by reason of the elastic force of the rotated bar 30 and the moveable braking-bar part 28. The braking-part 22 thus reaches the area of the side wall 20, as shown in the right in FIG. 2. The drive wheels of the car 14 are released, so that said car starts.

The pivoting of braking-bar 22 is so formed, that even by braking-bar 22 pivoting inwardly, as shown in FIG. 1 at left and FIG. 3, the car 14 can be set free out of the apparatus, if the car receives suitable momentum from behind, by a second car in motion.

While the present invention has been particularly described in terms of specific embodiments thereof it will be understood that in view of the present disclosure numerous deviations therefrom and modifications thereupon may be readily devised by those skilled in the art.

I claim:

1. An apparatus for starting spring-driven toy cars having a housing; said housing being formed of a fitted base plate having a width equal to that of the car and vertical side walls in which at least one of said side walls has at least one portion which is pivotable partially inward over said base plate; wherein: said one side wall (20) is provided with a braking bar (22) disposed parallel to said base plate (12) at a level of the upper area of a wheel of a car adapted to traverse said base plate; said braking-bar (22) being pivotable inwardly at one part of its length against a tension-spring at the level of the side wall; and locking-means (46), (48), (50) associated with said housing and movable with respect to said side wall between two positions, said locking means being adapted to release the braking-bar in one position and hold the braking-bar in place pivoted inwardly over said base plate in the other position.

2. An apparatus according to claim 1, wherein: the braking-bar (22) is formed of the side wall (20) separated partly by slots (24), (26), in which the elasticity of the material forms the spring-tension.

3. An apparatus according to claim 2, wherein: the braking-bar (22) is connected at both ends to the side wall (20) and is separated in the middle of its length and the locking-means (46), (48), (50) is engageable with the middle of the braking-bar at both ends.

4. An apparatus according to claim 1 wherein: a second bar (30) is parallel to braking-bar (22) and is connected to the braking-bar by vertical arms (34) in the area of the side wall (20).

5. An apparatus according to claim 3 wherein: the second bar (30) is a part of the side wall separated therefrom by length-wise slots (26), (32) and connected to the side wall (20) at both ends, and is connected with the free ends (36) of portions (28) of the braking-bar (22) by respective vertical arms (34).

6. An apparatus according to claim 5, wherein: free ends (36) of both portions (28) of the braking-bar (22) extend outwardly and are tapered on their bottom edge.

7. An apparatus according to claim 4, wherein: a friction surface in the area of the braking-bar is provided being fixed to the braking-bar (22) and the second bar (30), said friction surface, extending at an angle opening upwardly on the outside of the housing of the side wall (20), and said locking-means being a vertical movable slider (50) in contact with said friction surface.

8. An apparatus according to claim 5 wherein: the friction surface is formed by the top edges (38) of the vertical plate-like arms (34) which extend toward the outside of the housing.

9. An apparatus according to claim 8; wherein: a slider is formed of a disk (50) having its periphery adjacent to the top edge (38) of the arm (34) and, whose axis (46) is located vertically in the middle between the arms and is axially movable in a flange (42) projecting from one of the upper sides of the side wall (20) to the outside of the housing.

10. An apparatus according to claim 9, wherein: the upper end of the top-edge (38) of the arm (34) has a section (40) parallel to the running edge of the arm, that provides a resting point for the disk (50) in its upper location.

11. An apparatus according to claim 9, wherein: the axis (46) of the disk (50) is formed of two sections connected to each other, of which one is connected to the disk and the other is connected to the control-head (48) arranged on the upper part of the flange (42).

12. An apparatus according to claim 11, wherein: both sections of the axis can be inserted one in the other and are provided with a notch-joint.

13. An apparatus according to claim 11 wherein: the disk (50) and the control-head (48) with the respective axis sections are plastic die-cast.

14. An apparatus according to claim 1, wherein: the housing with the bar is formed of a single plastic die-cast part.

15. An apparatus according to any one of the preceding claims, wherein: the housing (10) has projecting tongues (16) on both ends and complimentary mounting installations to said tongues.

16. An apparatus according to claim 1, wherein: two or more braking-bars (22) are arranged one behind another in a lengthwise direction of the housing.

* * * * *